US006648550B1

(12) United States Patent
Parker

(10) Patent No.: US 6,648,550 B1
(45) Date of Patent: Nov. 18, 2003

(54) SUBTERRANEAN DRAINAGE DEVICE

(76) Inventor: Alton F. Parker, 16 Tracey Ct., Clifton Park, NY (US) 12065

( * ) Notice: Subject to any disclaimer, the term of this patent is extended or adjusted under 35 U.S.C. 154(b) by 0 days.

(21) Appl. No.: 10/318,644

(22) Filed: Dec. 16, 2002

Related U.S. Application Data

(63) Continuation-in-part of application No. 10/292,298, filed on Nov. 12, 2002.

(51) Int. Cl.[7] ..... E02D 19/00

(52) U.S. Cl. ..... 405/50; 405/43; 405/45; 52/169.5

(58) Field of Search ..... 405/50, 43, 44, 405/45, 47; 52/169.5

(56) References Cited

U.S. PATENT DOCUMENTS 3,888,087 A 6/1975 Bergsland
4,045,964 A * 9/1977 Barclay ..... 405/50
4,246,305 A * 1/1981 Delattre ..... 405/50
4,572,700 A * 2/1986 Mantarro et al. ..... 405/45
5,190,404 A * 3/1993 Kiyokawa et al. ..... 405/45
5,857,297 A 1/1999 Sawyer
5,934,828 A * 8/1999 Hu et al. ..... 405/43
6,247,874 B1 * 6/2001 Hu ..... 405/43

* cited by examiner

*Primary Examiner*—Heather Shackelford
*Assistant Examiner*—Frederick L. Lagman
(74) *Attorney, Agent, or Firm*—Fredric Morelle

(57) ABSTRACT

A water-impervious, non-biodegradable, unitary drainage device with multi-directional rollup capability. The invention features a monolithic "sandwich" construction consisting of planar top and base sheets, set apart by an array of supports that are disposed between and integrally joined to the sheets. Selective and off-set through-cuts, in the top and bottom sheets, impart to the invention the multi-dimensional rollup capability. Rods, optionally hollow, are used as splines to connect two or more of the devices, so that their internal drain channels are in an efficient confluent alignment.

20 Claims, 4 Drawing Sheets

SUBTERRANEAN DRAINAGE DEVICE

This application is a Continuation-in-Part of U.S. patent application Ser. No. 10/292,298 filed on Nov. 12, 2002, by the same inventor and entitled: Drainage and Footing Form Device.

STATEMENT REGARDING FEDERALLY SPONSORED RESEARCH OR DEVELOPMENT

Not Applicable

BACKGROUND OF THE INVENTION

1. Field of the Invention

This invention relates generally to devices and constructs used to effect subterranean drainage from building entrenchments, such as footings, foundations and walls, where seepage and ground water are a problem, and also under garage and basement floors where overburden of concrete exacerbates the drainage problem. More specifically, this invention embodies an improvement to known devices that can be treated as a rigid apparatus, with respect to installation; yet, it can be rolled up in one or two directions, as well as in two alternate directions.

2. Discussion of Relevant Art

A late development in drainage devices is seen in U.S. Pat. No. 5,857,297, issued to Sawyer in 1999, entitled: FOUNDATION WALL CONSTRUCTION ('297). This device is a rigid, plastic "sandwich", defined by two parallel plastic sheets (or surfaces) that are integrally formed with and set apart by a multiplicity of parallel partitions, which effect a plurality of channels. Thus, it is a rigid, monolithic structure; and, it bears perforations in the sheet facing the soil. Generally, the '297 device, like all such apparatus, is installed with a filter fabric adjunct, or large aggregate, interposed the soil and the perforations. Being rigid, it lacks the rollup capability sought by the instant inventor; and thus, it is principally this device that is improved herein. Use of the Sawyer article, as well as the instant invention, with geo-textile filter fabrics is well-known in the field.

As indicative of the art that pre-existed before the above patent, U.S. Pat. No. 3,888,087, for FOUNDATION WALL PROTECTIVE SHEET ('087), offers one of the first devices for providing dimples (posts or detents), as a stand-off mechanism for spacing a filter fabric from the core (base) of the device, and a physical folding crease to accommodate bending about a foundation. This apparatus is quite flexible, but using only a filter fabric as a second ply, it lacks the overburden capability of '297. The instant inventor incorporates the stand-off concept with his improvements and, while acknowledging the requirement for filter fabric for most installations, avoids the high flexibility character of '087.

INCORPORATION BY REFERENCE

Because they show both the present state of the art in drainage devices having an ostensible sandwich structure, as well as disclosing various standoff mechanisms, U.S. Pat. Nos. 5,857,297 and 3,888,087 are hereby incorporated by reference.

DEFINITIONS

Generally throughout this disclosure, words of description and claim shall have meanings given by standard English usage; however, certain words will be used that may have a more stylistic meaning and are defined as follows:

construct—herein, generally, an article or a building structure;

continual—having intermittent, or periodic, breaks or discontinuities;

continuous—having no breaks or discontinuities;

integral—necessary to complete or in itself complete;

partition—an projection separating two planar sheets, incipiently continuous but rendered continual by various slices, according to the instant teaching;

off-set—a term describing the state of slices, or slice patterns, that are parallel to others of the genre, but not overlapping nor superposed—as opposed to "alternating", which compels an ordered off-setting of patterns;

posts—as used herein, projected elements, also dimples (in prior art) or detents;

rigidity—a physical property of an object wherein the object substantially resists deflection in a particular dimension (direction) or plane;

slice—a through-cut in the surface(s) of the invention that passes through an intervening partition, but does not penetrate the opposite surface; and unitary—having wholeness, as in a single unit or monolith composed of plural members.

The above listing is not exhaustive. Certain other stylized terms, used previously or hereafter, are defined at the time of their first usage or placed in quotation marks and used with conventional wording.

BRIEF SUMMARY OF THE INVENTION

The instant inventor has overcome the deficiencies or limitations of the earlier art by providing an inexpensive, easily applied innovation that provides rollup capability to a hitherto, state-of-the art, rigid drain device.

The preferred embodiment of the invention is worked on a pre-existing drainage device that consists in a generally water-impervious, semi-rigid plastic "sandwich", having top and bottom planar members separated by a series of parallel partitions or a post matrix, either forming an integral and monolithic unit with the planar members. Foramens are provided on the surface that is interposed the device and a water source, such as ground or under-the-floor seepage. Whether the partition, or post, interstitial paradigm is employed, remains a manufacturer's and consumer's choice. In either structure, channels are formed for the communication of waters through a surface of the sandwich and into a drainage network. The pristine sandwich device is, in itself, capable of withstanding considerable overburden without collapsing; however, it is quite rigid and must be cut several times, on site, to conform to discontinuities in the various constructs employing ground water drainage.

The instant invention modifies the sandwich device by placing in it a series of linear slices ("cuts") that imbue the sandwich with the desired high degree of flexibility, while retaining essentially all of its structural strength. In a first, preferred embodiment, sets of parallel slices (see DEFINITIONS, above) are placed in both top and bottom planes of the sandwich device transverse the parallel partition array or between the row-column elements of the post matrix. It is intuitive that the "slice sets" must off-set relative to each other, lest the sandwich be cut through. In an alternate embodiment, the first is further modified by a second pair of slice sets, additional to the first, and again, the top slices off-set in respect of the bottom, but running orthogonal to those slice sets of the first. In the second case, the slices pass between partitions and/or posts.

The desired goal being achieved, there is acquired not only a device that has unlimited in-ground use, with high overburden sustainability, but one having a high degree of flexibility that allows compact rolling, for ease in handling, storage and shipment.

DETAILED DESCRIPTION OF THE INVENTION

Figure 1:
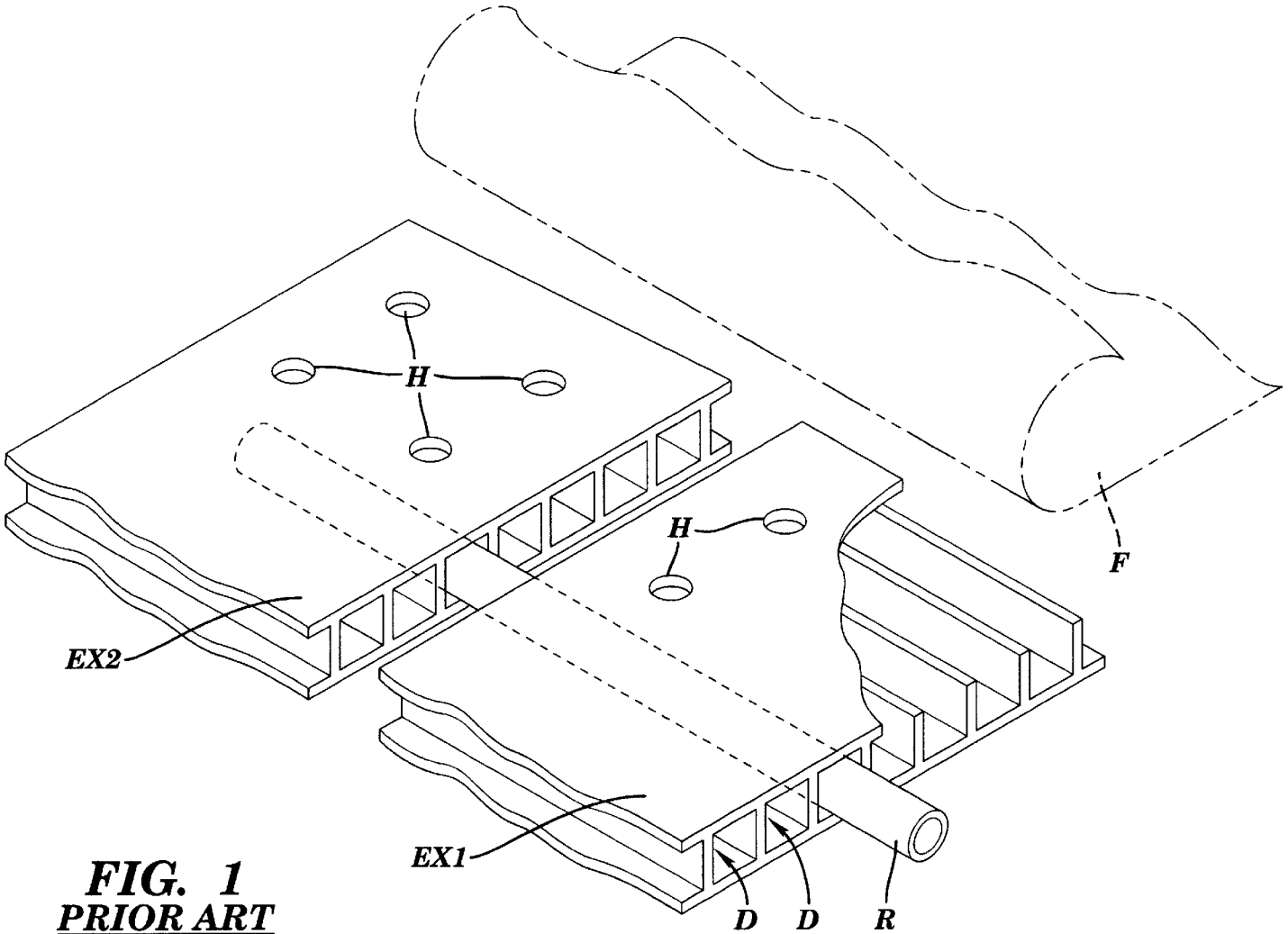
FIG. 1 PRIOR ART
FIG. 1 is a prior art illustration of a subterranean drainage article that is improved by the instant invention.

The drainage device of the prior art, shown in FIG. 1, is employed in construction situations where there is required an unusual strength to sustain heavy earth, gravel or concrete overburdens, such as those encountered in basements, parking garages and earthworks. It is packaged as stacked elements and, because of its monolithic structure, resists the rolling that attends a segmented or discontinuous structure. For the most part, there is shown here a first example or exhibit EX1 of the device, and a second EX2, joined by an adjunct, a hollow coupling rod or spline R, devised by the instant inventor to aid in the alignment of the apparatus. In the prior art, the device is either affixed to a wall or lain on a prepared earthwork. Perforations or holes H are provided so that seepage will readily enter the otherwise liquid-impermeable top plane. For the sake of clarity, such hole H illustrations will be generally omitted from subsequent drawings, with but a nominal few being shown in FIGS. 4, 7 and 8. Final to installation, a filter fabric F is lain over the device(s), to exclude soil particulate or liquid suspensions that could foul the drain channels D.

Figure 2:
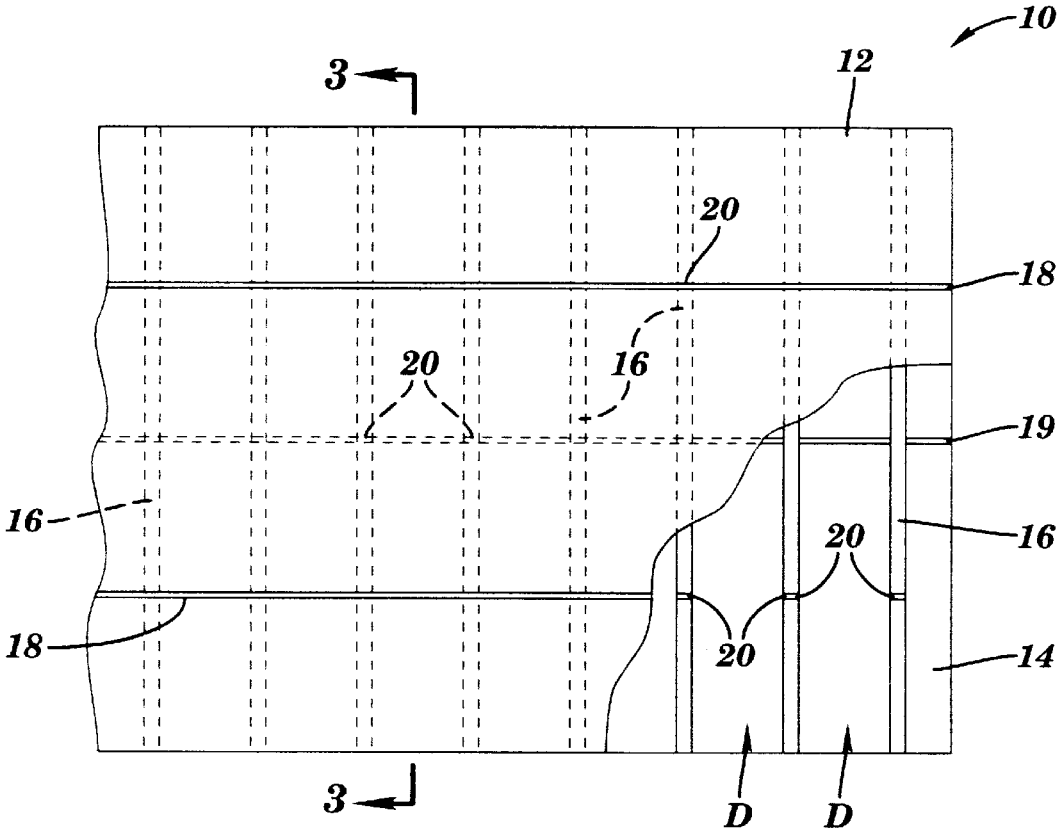
FIG. 2 is a plan view of the FIG. 1 device conformed to the improvements of the invention.
Figure 3:
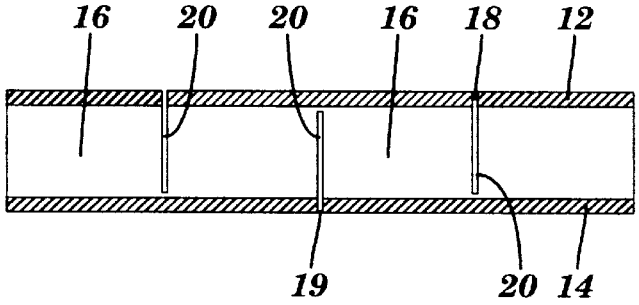
FIG. 3 is an elevation of the invention, taken at 3—3 of FIG. 2.
Figure 7:
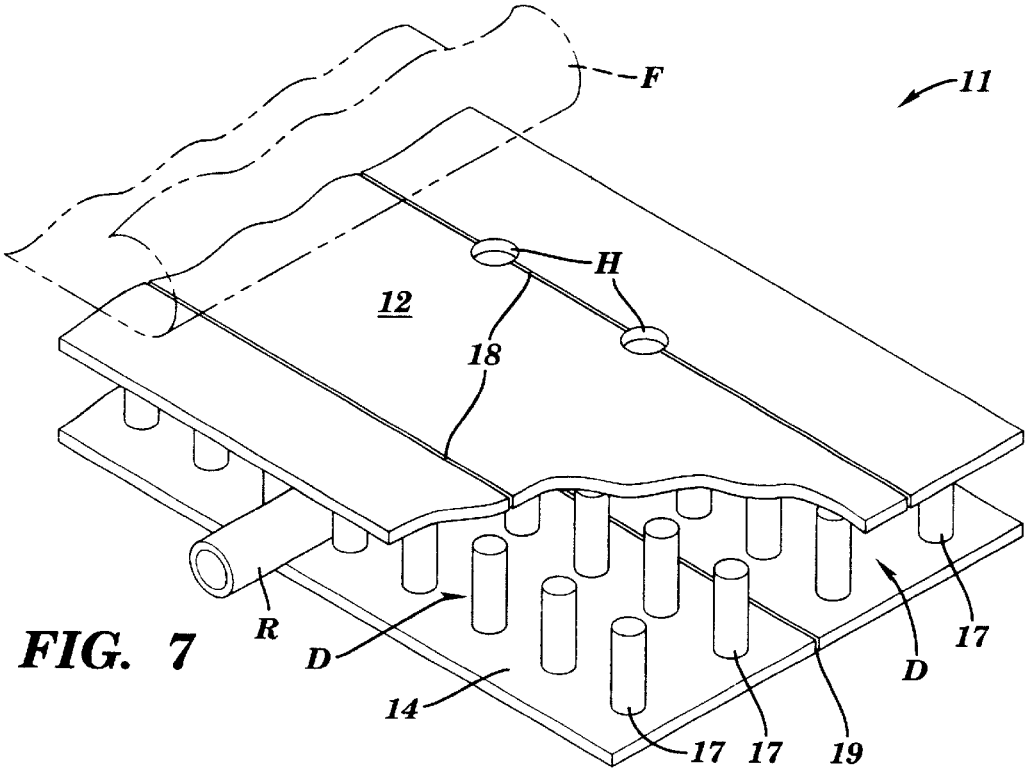
FIG. 7 is an isometric illustration of the invention featuring post-type projections.
Figure 8:
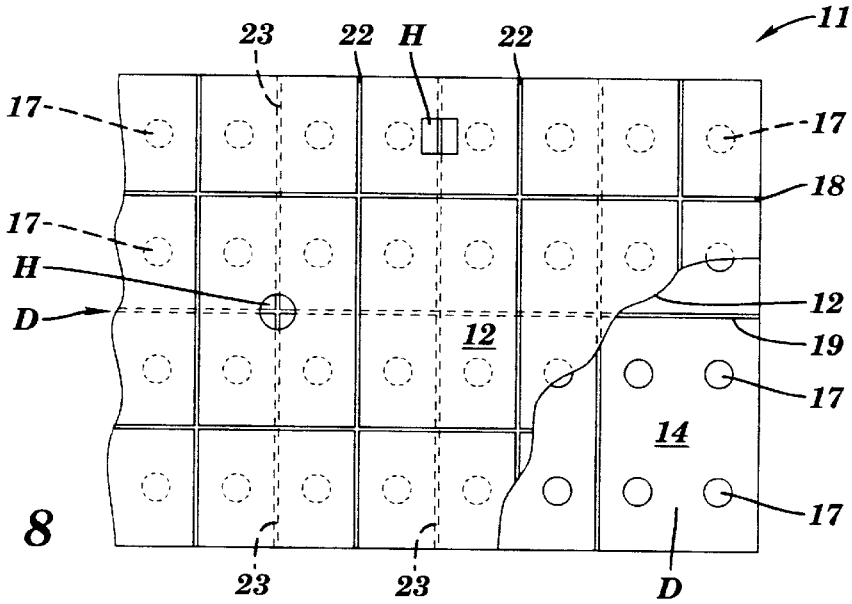
FIG. 8 is a plan view of the invention featuring cross-pattern slices of the alternate embodiment.

Referring to FIG. 2, there is shown a partial cut-away plan view of the preferred embodiment of the invention 10. The monolithic, non-biodegradable and, preferably, polymeric plastic structure consists integrally in a top plane 12, a bottom plane 14 and an interstitial parallel partition 16 structure. That the separating partitions are perpendicular to the separated planes 12,14, as shown in the post-separated model of FIGS. 7 and 8, is not a hard and fast rule of the instant inventor. Because the article of this invention is most easily acquired by the process of extrusion, almost any strength-lending interstitial structure may be realized; for example, X-shaped supports (not shown) would do just as well in providing weight-bearing strength and shape retention. The only attribute required, besides the foregoing, is that water passages or drain channels D be provided. Continuing in FIG. 2, slices 18 are shown in the top plane; such top plane slices are continued through any intervening supports and are termed, simply, support slices 20. It must be noted here that the support slices 20 are confined only to the support mechanisms 16 and do not enter the bottom plane 14. Referring to the cut-away portion of FIG. 2, there can be seen a single instance of a bottom plane slice 19, in off-set relationship with any top plane slice 18. Like the slicing technique used in the top plane, bottom plane 14 slices 19, cut through any intervening support 16, but not the top plane 12. FIG. 3, taken at 3—3 of FIG. 2, exemplifies this feature of the invention. Referring specifically to FIG. 3, this elevation view, looking into the partition structure, shows the top plane 12 slices 18 penetrating the intervening partition 16 as partition slices 20; but, the slices do not penetrate the opposite plane 14. The off-set character of the slices in a plane surface cutting through only intervening supports, but not the opposite plane, forms the nexus of the invention. It is this unique technique that allows the invention to be rolled into two dimensions, above or below the plane shown in FIGS. 1, 3, and 5–7. It is stressed that the instant inventor teaches an off-set slicing technique, rather than an "alternating" one. In this invention, the manufacturer has, for any reason, the option of employing any slice pattern in an ordered or non-ordered manner, depending on the desired degree of flexibility (and thus, roll ability).

Figure 4:
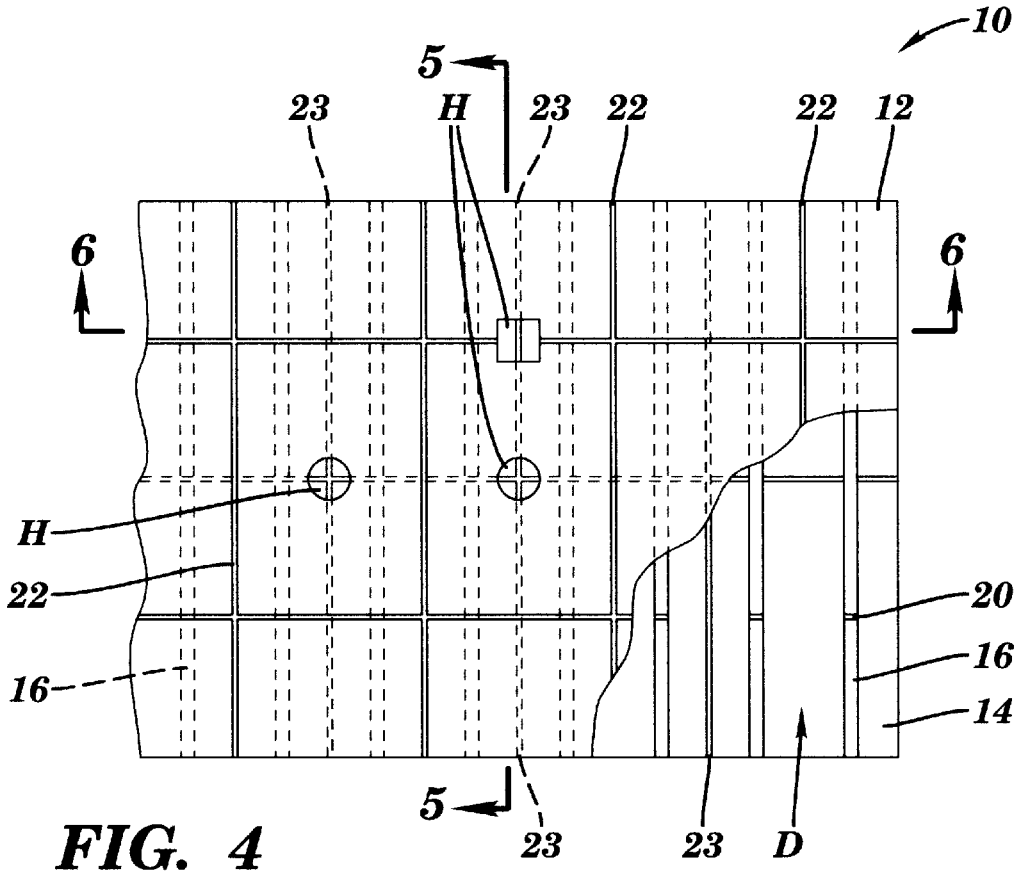
FIG. 4 is a plan view of the FIG. 2 device conformed to the improvements of the alternate embodiment of the invention.

In a cut-away plan view, FIG. 4 depicts an alternate embodiment of the invention 10 having another off-set slice pattern, similar to that of FIGS. 2 and 3, but in an orthogonal or cross-hatch array. This embodiment features the second array composed of parallel top slices 22 and bottom slices 23; here, the slices 22,23 are off-set from each other and situated, at closest proximity, between adjacent partitions. Holes H are show in nominal quantity, in communication with the channels D. It should be understood that such perforations may take on a host of shapes or sizes, often chosen by a consumer, depending on whether it intends to use fabric or aggregate interposed the device and a seepage source.

Figure 5:
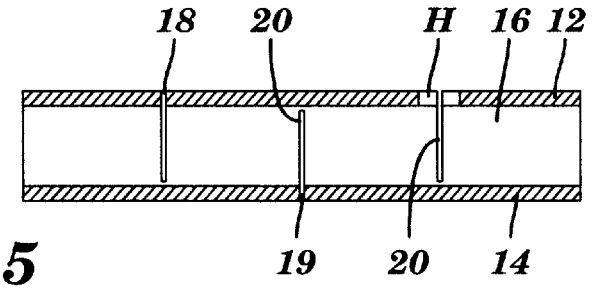
FIG. 5 is an elevation of the alternate embodiment of the invention, taken at 5—5 of FIG. 4.
Figure 6:
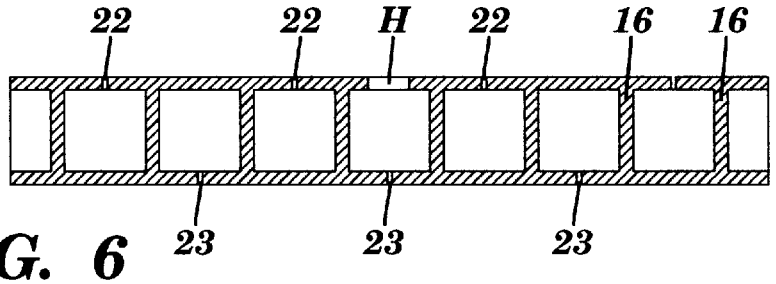
FIG. 6 is an elevation of the alternate embodiment of the invention, taken at 6—6 of FIG. 4.

FIGS. 5 and 6, taken respectively at 5—5 and 6—6 of FIG. 4, are analogous to FIG. 3, showing, in two views, that the second slice pattern differs little from the first, but now lends further bi-directional roll ability in the second, orthogonal dimension of the "sandwich" plane. Again, the hole(s) H shown is(are) nominal, and represent plural such apertures in the design.

The isometric illustration of FIG. 7, along with its correlative plan view, FIG. 8, show, essentially, the invention 10 previously described, but in an alternate embodiment 11. Here, the invention takes on the basic aspects of the instant inventor's earlier work: a bottom sheet 14 of non-biodegradable, plastic type of material (ABS, PVC, CPVC, polypropylene or similar); truncated post-type projections 17, from and integrally joined to the base sheet; and a top, planar structure 12 secured to the tops of the posts 17. The top structure effected here (and in his earlier work) is a plurality of strips, but it is most accurately defined as a continuous planar sheet that is rendered discontinuous by one or more slices 18, as shown. All other previously disclosed incidents of the invention are present, including: holes H in one surface (of the plane/sheet); off-set top and bottom slices 18,19, running in one direction; a second set of similarly off-set top and bottom slices 22,23, running essentially 90° to slices 18,19; drains/channels D; solid or hollow coupling rod R; and, as seen in FIG. 7, filter fabric F.

Earlier, it was discussed that the invention readily lent itself to an extrusion construction process. However, this is not a limiting factor in its physical realization. As shown in FIGS. 7 and 8, bottom plane 14 projects cylindrical posts 17, which portray, in the abstract, any variety of frusto-geometrical constructs, such as rectilinear, trapezoidal or cylindrical detents, dimples or projections. Such constructs are formed by extrusion, molding, machining and/or rolling mill techniques. Subsequently, the top plane(s) 12 is(are) affixed to the lower plane-support ensemble and final machining takes place to achieve the character of this instant invention. Since the field is well informed of the manufacturing techniques employed to make this invention, further comments of this nature are now deferred.

After the top plane 12 is provided, machining is performed, as necessary, to acquire the cuts or slices 18, 19 and holes H.

What is claimed is:

1. A multi-channeled, drain device for conveying liquid, passing into it from a first locale to another locale and comprising:

first and second sheets of a planar, water-impervious and flexible material;

an array of separated support members discretely and connectedly interposed the first and the second sheets, the separated members effecting channels therebetween; and, a first set of two or more parallel linear slices passing through the first sheet and any intervening support members and a second set of two or more parallel linear slices passing through the second sheet and any intervening support members, wherein the first and the second sets of slices are in parallel and off-set, non-superposed patterns with respect to each other.

2. The device of claim 1 bearing a plurality of foramens through the surface of the first sheet, said foramens in communication with said channels.

3. The device of claim 1 further comprising at least a third linear slice passing through the first sheet and at least a fourth linear slice passing through the second sheet, wherein the third and the fourth slices are in parallel and off-set relationship with respect to each other and are both in orthogonal registration with respect to the first and the second sets of slices.

4. The device of claim 1 further comprising at least one spline element defined by an elongated shaft adapted for insertion between the support members of one piece of the device and the support members of another piece of the device, to effect a joining of said pieces and whereby the one piece and said another piece are so disposed that a plurality of channels in each said pieces are in confluent registry.

5. The device of claim 4 wherein said shaft is hollow.

6. The device of claim 2 further comprising a filter fabric for interposition between said plurality of foramens and a fluid source.

7. The device of claim 1 wherein the support members comprise a plurality of posts arrayed in a row-column matrix.

8. The device of claim 1 wherein the support members comprise an integral array of parallel, rectilinear partitions.

9. The device of claim 1 wherein the support members comprise a plurality of posts arrayed in a row-column matrix.

10. The device of claim 1 wherein the support members comprise an integral array of parallel, rectilinear partitions and wherein the partitions run transverse the first and the second sets of slices and comprise said intervening support members.

11. A monolithic, multi-channeled drainage apparatus constructed of a firm, flexible, non-biodegradable material and comprising:

a first planar member and a second planar member;

said first and said second members set apart and connected by a row-column matrix of post elements effecting multiple fluid channels within the apparatus, the apparatus further featuring a first set of parallel, elongated cuts through the first member, the cuts situated parallel to rows of the matrix and a similar set of cuts in the second member, wherein the first set of cuts is in an off-set, non-superposed relationship with said similar set of cuts.

12. The apparatus of claim 11 further comprising linear through-cuts in the first and second members parallel to columns of said matrix, said linear through-cuts in each the first and the second members being set apart, parallel and non-superposed with respect to each other and orthogonal to said elongated cuts of the first set and the similar set.

13. A monolithic drainage apparatus constructed of a firm, flexible, non-biodegradable material having multiple drain channels therein and comprising:

a first planar member and a second planar member;

said first and said second members set apart and connected by an array of parallel partitions and featuring a first set of parallel, linear cuts through the first member, the cuts situated transverse to and through the partitions; and, a similar set of cuts in and through the second member and intervening partitions, and wherein the similar set of cuts is in an off-set, non-superposed relationship with the first set of cuts.

14. The apparatus of claim 13 further comprising linear through-cuts in the first and the second members between said partitions, said through-cuts in each the first and the second members being set apart, parallel and non-superposed with respect to each other and orthogonal with respect to said linear cuts of the first set and the similar set.

15. The apparatus of claim 11 including a plurality of foramens through the first member, said foramens communicating with said channels.

16. The apparatus of claim 13 having a plurality of foramens through the first member, said foramens communicating with said channels.

17. The apparatus of claim 15 further comprising a filter fabric for interposition between said plurality of foramens and a fluid source.

18. The apparatus of claim 16 further comprising a filter fabric for interposition between said plurality of foramens and a fluid source.

19. The apparatus of claim 11, further comprising at least one rod element, the element being optionally hollow and adapted to align a first exhibit of the apparatus with a second exhibit thereof, so that said channels of the first exhibit and the second exhibit are in confluence.

20. The apparatus of claim 13, further comprising at least one rod element, the element being optionally hollow and adapted to align a first exhibit of the apparatus with a second exhibit thereof, so that said channels of the first exhibit and the second exhibit are in confluence.

* * * * *